US006082630A

United States Patent [19]

Bohrer

[11] Patent Number: 6,082,630

[45] Date of Patent: Jul. 4, 2000

[54] VEHICLE MOUNTED HIGH PRESSURE CLEANING APPARATUS

[76] Inventor: Lee A. Bohrer, 306 Ter. View West, Mankato, Minn. 56001

[21] Appl. No.: 08/980,530

[22] Filed: Dec. 1, 1997

[51] Int. Cl.[7] ..... B05B 9/00

[52] U.S. Cl. ..... 239/127; 239/172; 239/197; 134/167 C; 134/168 C; 137/355.12; 137/355.2

[58] Field of Search ..... 239/124, 127, 239/172, 195–197, 526, 532; 134/167 C, 168 C; 137/355.12, 355.16–355.19, 355.2

[56] References Cited

PUBLICATIONS

Lancaster, John. *Sewer Cleaning Trucks, Jet, Vacuum or Both?*; Cleaner; pp. 42–44; Mar. 1997 issue (mailed Feb. 18, 1997); Cole Publishing Inc. Three Lakes, WI 59562.

Advertisement: Underground Inc.; p. 7; Cleaner; pp. 42–44; Mar. 1997 issue (mailed Feb. 18, 1997); Cole Publishing Inc. Three Lakes, WI 59562.

Advertisement: GapVax; p. 7; Cleaner; pp. 42–44; Mar. 1997 issue (mailed Feb. 18, 1997); Cole Publishing Inc. Three Lakes, WI 59562.

Advertisement:; Vac–Con; p. 9; Cleaner; pp. 42–44; Mar. 1997 issue (mailed Feb. 18, 1997); Cole Publishing Inc. Three Lakes, WI 59562.

Advertisement: O'Brein Mfg; p. 33; Cleaner; pp. 42–44; Mar. 1997 issue (mailed Feb. 18, 1997); Cole Publishing Inc. Three Lakes, WI 59562.

Advertisement: AquaTech; p. 35; Cleaner; pp. 42–44; Mar. 1997 issue (mailed Feb. 18, 1997); Cole Publishing Inc. Three Lakes, WI 59562.

Advertisement: US Jetting, Inc.; p. 37; Cleaner; pp. 42–44; Mar. 1997 issue (mailed Feb. 18, 1997); Cole Publishing Inc. Three Lakes, WI 59562.

Advertisement, US Jetting, Inc.; p. 41; Cleaner; pp. 42–44; Mar. 1997 issue (mailed Feb. 18, 1997); Cole Publishing Inc. Three Lakes, WI 59562.

Advertisement: Vactor Mfg, Inc.; p. 47; Cleaner; pp. 42–44; Mar. 1997 issue (mailed Feb. 18, 1997); Cole Publishing Inc. Three Lakes, WI 59562.

Advertisement: Lely Corp, Lely Southwest, Lely Pacific; p. 51; Cleaner; pp. 42–44; Mar. 1997 issue (mailed Feb. 18, 1997); Cole Publishing Inc. Three Lakes, WI 59562.

Advertisement: Spartan; p. 85; Cleaner; pp. 42–44; Mar. 1997 issue (mailed Feb. 18, 1997); Cole Publishing Inc. Three Lakes, WI 59562.

*Primary Examiner*—Andres Kashnikow
*Assistant Examiner*—Steven J. Ganey
*Attorney, Agent, or Firm*—Moore & Hansen

[57] ABSTRACT

A vehicle mounted high pressure water cleaning apparatus includes a water delivery system, hydraulic system, and an electrical system working together to provide, alternatively, high pressure water for a cleaning operation, or recirculation of high pressure water back to a water tank. The hydraulic system is operable to either direct water toward a cleaning operation, or to wind in or play out the water delivery hose while either supplying water to the delivery hose under pressure or recirculating the water back to the water tank.

13 Claims, 2 Drawing Sheets

VEHICLE MOUNTED HIGH PRESSURE CLEANING APPARATUS

BACKGROUND OF THE INVENTION

The present invention relates generally to systems for cleaning objects using high pressure fluid. Specifically, it relates to a vehicle mounted high pressure water cleaning apparatus.

A wide variety of apparatuses used for the delivery of high pressure water through a hose for cleaning various objects such as pipes are known in the art. Such high pressure systems include apparatus to deliver fluid such as water to a variety of pipes to clean debris and blockage from the pipes which may accumulate therein.

Such cleaning apparatuses for the cleaning of pipes and the like generally use water delivered through a hose, with the water being delivered at high pressure to more effectively clean any debris or blockages which may be present. Delivery of water at high pressure can create a number of problems with the systems used for its delivery. Typically, high pressure systems require special components designed to be used at high pressure, including hoses, nozzles, and pumps. Further, the change from high pressure to low pressure and back places a very large strain on the components of such a delivery system.

For example, when water is first delivered at high pressure, the strain on components such as nozzles can be immense, as the pressure does not build up gradually. Similarly, when a nozzle or valve is closed in such a system, a large pressure wave may be generated. This wave is sometimes referred to as a water hammer. Water hammers and sudden pressure changes, due to their extreme nature, can damage and destroy even high pressure components.

To combat these problems, systems may typically use a gradual buildup of pressure, and a gradual diminishing of pressure, when operating the system. This gradual buildup and release of pressure results in extra time being taken to perform a cleaning operation. Further, if cleaning must be stopped in mid process, even more time is added to the overall time taken by a cleaning. The longer each job takes, the fewer jobs can be done.

A further problem exists with the requirement of increasing and decreasing pressure frequently. Over time, the strain on a system subjected to this type of use will lead to a shorter life span of components. It would be desirable to provide a high pressure water cleaning system which is able to maintain a constant or near constant pressure load on its components.

Systems which use a gradual build up of water pressure also have problems with excess water spillage or leakage from the pipe being cleaned before adequate cleaning pressure is reached. This results in an undesirable cleaning operation. Sufficient pressure build up to clear a blockage may not be achieved until several minutes after a cleaning operation is begun.

It would further be desirable to provide a high pressure water cleaning apparatus that can generate a high pressure water stream very quickly, and without resultant damage to the components. It would also be desirable to provide such a system which can quickly stop high pressure water flow, again without resultant damage to the system.

Typical high pressure water cleaning systems use a length of hose extending from a hose supply, usually mounted on a truck or other vehicle. High pressure water is delivered through the hose. The controls for the apparatus are positioned at the vehicle. To properly clean pipes and the like, the outlet of the hose must be placed in the drain, and often is fed a distance into the pipe, cleaning as it is fed through the pipe. Since the hose end must be placed into a pipe, usually from the inside of a structure such as a building or a house, two operators are usually used in performing a cleaning operation. The first operator takes the hose into the structure and fits it into the pipe to be cleaned. The second operator remains at the control station to operate the controls, assuring appropriate pressure changes so as not to cause damage to the equipment. If only one operator is available, the startup and shutdown of a cleaning system may require numerous and frequent trips back to the controls of the system. This process results in extra time being taken to perform a cleaning operation. If two operators are used, the amount of time required may be reduced, but the total man hours for a cleaning operation is doubled for two operators.

Single operator systems are known in the prior art. However, single operator systems require a number of electrical cord connections and a control panel to allow the single operator to properly adjust the various systems of the cleaning apparatus, including pressure, pump speed, and the like. Since the typical cords for such adjustment and control functions are relatively short, a large amount of expense and effort must be undertaken in order to accomplish single operator use. It would be desirable to provide a cleaning system which may be operated by one operator, and which also has the added advantages of rapid high pressure operation discussed above.

Water for a cleaning operation is typically stored in a tank located on the vehicle. Such tanks have a limited capacity. When a cleaning operation must gradually increase pressure to the components, or gradually release pressure from components, excess water may be used. Further, if a single operator must return to the control station to begin or end a cleaning, further water may be wasted. Since water capacity is limited, the more water wasted, the more times a tank must be refilled. Refilling locations may be some distance from the site to be cleaned. It would be desirable then to provide a high pressure water cleaning system which minimizes water wastage.

Electrical power supplied to systems such as those described above may come from a variety of sources. If standard house electrical current from a 120 volt system is used, the potential for serious shock or even electrocution becomes possible. Since the components of a water cleaning apparatus necessarily come into frequent contact with damp or even wet situations, use of 120 volt electricity can be very dangerous. It would be desirable to provide a high pressure cleaning apparatus that reduces the potential for serious electric shock. Further safety features as remote shutoff switches and multiple redundancies would also be desirable.

Typical high pressure pumps utilized in apparatus for high pressure cleaning require large power supply to operate. These large pumps also generally require a large amount of room because they are typically run by an auxiliary engine sufficient to provide adequate power for their operation. Further, coupling of power from the vehicle transmission has been accomplished by using the vehicle transmission to operate a hydraulic system. Such a system has several problems. These include a significant loss of engine power through the hydraulic coupling, as well as the potential for a large spill of hydraulic fluid if hydraulic fluid lines under pressure burst. It would be desirable to provide a cleaning apparatus which can directly power a large jet pump from the drive train of the vehicle, without requiring the use of hydraulics or auxiliary engine.

BRIEF SUMMARY OF THE INVENTION

The present invention overcomes the problems of the prior art by providing a vehicle mounted high pressure cleaning apparatus which is operable by a single user, and which provides nearly instantaneous high pressure cleaning liquid, such as water, reducing water usage and increasing efficiency, yet which also reduces wear and tear on the system components.

The present invention is a vehicle mounted high pressure cleaning apparatus which provides cleaning liquid such as water at high pressure through a conduit or hose to clean pipes and the like. Cleaning liquid stored in a reservoir is pumped by a high pressure pump through hose to a nozzle, creating a high pressure spray. A valve in the hose line allows diversion of high pressure water flow from the nozzle end of the hose back to the reservoir under pressure. This diversion under pressure alleviates the problems with pressure build up. The perceived pressure load on the system remains substantially constant through the cleaning process.

A hydraulic system is used to operate the water valve, with a hydraulic cylinder connected to and moving the water valve between a position in which the pressurized water is diverted to the hose end for cleaning, and a second position in which the high pressure water is diverted back to the water reservoir. The hydraulic system is also alternatively used to operate a hose reel on which hose may be wound. The hydraulic system can operate the hose reel to wind in or play out hose while still pumping high pressure water through he nozzle for cleaning.

The multi-function hydraulic pump and reservoir system of the present invention allows the pre-setting of a desired water pressure for pumping. This pressure can be maintained at a substantially constant level throughout a cleaning operation, eliminating the need for repeated gradual increase and decrease of pressure for adjustment purposes. The substantially constant pressure, whether the water system of the present invention is pumping water at high pressure through the nozzle for cleaning or circulating high pressure water back to the reservoir, does not need to be pressure level adjusted. Further, because the load on the water system remains substantially constant, the jet pump will not be able to free wheel because of the substantially constant load. This eliminates the stresses associated with free wheeling of the jet pump.

The substantially instantaneous supply of high pressure cleaning water largely eliminates the spilling and leaking problems of systems which gradually build up water pressure. Many cleaning operations can be accomplished by pushing the cleaning hose and nozzle down the pipe or line to the point of a blockage before turning the high pressure water on. By providing high pressure water substantially instantaneously, the blockage can be opened quickly with little or no water backup, spillage, or leakage. With a gradual pressure increase, a significant amount of water would accumulate in the pipe and spill out before full power is reached to open the line. The cleaning apparatus of the present invention largely eliminates the undesirable mess a leakage, spillage, or backup creates.

An electrical system powered by the electrical system of the vehicle provides twelve volt power to the system. This twelve volt power eliminates some of the potential hazards of higher voltage electrical systems. The electrical system of the present invention comprises a pair of pressure switches, as well as a power source, several solenoids, and several switches, all integrated with the operation of the hydraulic system discussed in general above. The electrical system initiates operation of the hydraulic system of the cleaning apparatus, and working in conjunction with the hydraulic system, allows the present invention to provide multiple functions for the hydraulic system. The hydraulic system is used both to operate the water valve which directs the flow of high pressure cleaning water, as well as controlling the hose reel that winds in or plays out the water hose. A single hydraulic reservoir and hydraulic pump are used for both functions of the hydraulic system. The cleaning apparatus of the present invention is driven directly from the drive train of the vehicle through the use of a direct coupling to the drive shaft of the vehicle. This is accomplished through the use of a gear box which serves to translate the revolutionary speed of the vehicle drive shaft to a secondary drive shaft at increased revolutions. This direct transmission of increased revolutionary speed results in more efficient operation of the jet pump of the present invention without the problems associated with a heavy auxiliary engine or an inefficient hydraulic system. The elimination of the extra space and weight required for an auxiliary engine allows the present invention to be mounted in a small vehicle, yet still carry a greater amount of water and have more storage space than a typical cleaning apparatus utilizing an auxiliary engine. The greater storage space provided increase the efficiency of the overall cleaning vehicle. Since a smaller vehicle may be used, it decreases the expense associated with operation of the vehicle, as well as providing a more esthetic cleaning apparatus for use in residential areas. Similarly, a commercial cleaning vehicle embodying the present invention can further increase water supply since no further equipment is needed for a larger vehicle. This further increase in water capacity results in a more efficient cleaning operation, since commercial cleaning operations may require larger amounts of water. The larger amount of water which is capable of being carried by a larger truck decreases the likelihood that a cleaning operation would need to be halted for refilling of the water reservoir. The components of the cleaning apparatus may all be placed in the protective structure of a preformed vehicle, and may then be insulated and isolated from the elements.

High pressure water flow through the hose for cleaning operations is generated through a coupling to the transmission system of the vehicle on which the present invention is mounted. A dual shaft system is used, with a power take off gear box from the vehicle transmission driving a second shaft. One shaft is coupled to the drive train of the vehicle and the other shaft is coupled to the jet pump of the present invention. A manual linkage is actuated to select the appropriate drive shaft. Operation of this linkage directs power from the transmission either to the drive train of the vehicle or to the jet pump drive shaft of the present invention. Once the jet pump drive shaft is selected, a magnetic clutch switch may be closed to energize a magnetic clutch which couples the rotating vehicle shaft from the power takeoff to the high pressure jet pump in order to set the jet pump in motion. The magnetic clutch is further controlled by a clutch actuation switch which serves as a safety feature to allow shut down of the jet pump at the control center for the present invention. Once the jet pump for generating high pressure water flow has been actuated, the hydraulic and electrical systems of the present invention allow operation in the various modes of the present invention.

The drive shaft from the transmission to the vehicle axle is cut and a power take off gear box installed. The gear box has two drive shafts to select from. One drive shaft is coupled to the axle of the vehicle, and the second is coupled to the jet pump. When the selection of drive shafts is being made, the vehicle transmission is placed in neutral, and a manual linkage mechanism connected to the split drive shaft power take off is pulled, selecting the desired drive shaft for operation. When the vehicle axle is selected, the transmission operates in normal fashion. When the jet pump drive shaft is selected, the transmission is put in low gear on the automatic transmission. Being in low gear prevents the transmission from jumping to the next higher gear as rpms increase. The gear box operates to increase the revolution speed of the jet pump to provide more efficient operation of the cleaning apparatus with lower engine speed.

The electrical circuit is energized and arranged as follows. Electrical power, preferably from the vehicle battery is supplied to the electrical circuit through the ignition switch of the vehicle. When the ignition switch of the vehicle is on, and the clutch actuation switch has been connected to energize the jet pump, the initial flow of high pressure water is from the jet pump through the hose and through the water valve back to the reservoir. A desired water pressure is chosen. The desired water pressure may be obtained by varying the revolution speed of the power take off shaft from the vehicle transmission. This may be accomplished using a remote throttle. A hydraulic cylinder operates the water valve. This hydraulic cylinder is a spring return cylinder attached to the water valve which will, when it is not under pressure, cause the water valve to divert water from the hose back to the reservoir. When it is desired to deliver high pressure water to the water hose for cleaning, a water valve switch, which is open when the water flow is to be diverted back to the reservoir, is closed.

This closure energizes two pressure switches. The pressure switches sense hydraulic pressure at the hydraulic cylinder. One pressure switch has an associated valve between the hydraulic pump and the hydraulic cylinder; and the other pressure switch has an associated normally open valve connected in a return fluid line between the hydraulic cylinder and the hydraulic reservoir. Normally closed is an electrical configuration. When there is low pressure at the hydraulic cylinder, the first pressure switch sending electrical power through the input terminal of the pressure switch to the first output terminal of the pressure switch. The first output terminal of the first pressure switch is electrically connected to a starter solenoid and to the normally closed solenoid valve. When the water valve switch is closed, an electrical circuit is completed which energizes the starter solenoid and the normally closed solenoid valve. The energized starter solenoid actuates a contact switch which completes a circuit between the battery of the vehicle and a DC motor which is coupled to the hydraulic pump. The hydraulic pump will then begin to operate, providing hydraulic fluid pressure in the hydraulic system. The normally closed solenoid valve opens to allow hydraulic fluid to flow to the hydraulic cylinder. The normally open solenoid valve closes to block hydraulic fluid relief to the hydraulic reservoir.

A hydraulic output selector valve allows the diversion of hydraulic fluid pressure either to the water valve hydraulic cylinder or to the hose reel of the present invention. When it is desired to generate high pressure water flow for a cleaning operation, the hydraulic output selector valve is manually moved so that it diverts hydraulic fluid pressure to the hydraulic cylinder attached to the water valve. When the hydraulic pressure at the water valve cylinder builds to a certain level, the cylinder will move, at the same time moving the attached water valve to a position in which the high pressure water flow from the jet pump is diverted to the water hose for a cleaning operation.

When this hydraulic pressure buildup is sufficient to cause the hydraulic cylinder to move the water valve to a jetting, or cleaning position, the first pressure switch senses the high pressure at the hydraulic cylinder, and breaks the circuit to its first output terminal. This closes the normally closed solenoid valve and opens the contact switch completing the circuit to the DC motor, shutting off the hydraulic pump and trapping high pressure at the hydraulic cylinder.

At the same time as the re-closing of the normally closed solenoid associated with the first pressure switch and the breaking of the circuit to the starter solenoid, the connection of the DC motor to its power source is also broken, turning off the hydraulic fluid pump. In this fashion, the hydraulic fluid pump does not need to operate in order to maintain high pressure water flow through the water hose.

When the operator desires to shut off high pressure water flow to the water hose, the water valve switch is opened. This breaks the circuit between the vehicle battery and the pressure switches, de-energizing them and causing them to revert to their non-energized positions, closing the solenoid valve associated with the first pressure switch and opening the solenoid valve associated with the second pressure switch. When the switches revert to their normal positions, the spring return normally open solenoid valves are no longer energized, and revert to their normal positions, relieving the hydraulic fluid pressure on the spring return hydraulic cylinder, which due to its spring return, moves to its normal position, causing the attached water valve to move to a position in which the high pressure water flow is diverted to the water tank.

Once the hydraulic fluid pump has been shut off, the hydraulic output selector valve may be opened to allow the hydraulic fluid pump to control the hose reel which in turn winds in or plays out the water hose. When the hydraulic selector valve is moved from its position in which it diverts hydraulic fluid to the hydraulic cylinder to its position in which it diverts hydraulic fluid to the hose reel, it actuates a contact switch which completes a secondary circuit to the starter solenoid, energizing the starter solenoid, and providing power to the DC motor of the hydraulic fluid pump. When the hydraulic fluid pump generates high pressure hydraulic fluid flow, this flow is diverted to the reel motor system for winding in or playing out the water hose.

The section of the hydraulic system which serves to operate the hose reel comprises a flow control valve, a forward/reverse valve, and a hydraulic motor to actually drive the hose reel on which water hose is wound. When hydraulic fluid flow is diverted by hydraulic output selector valve to the hose reel, the flow control valve allows the varying of hydraulic fluid flow to the hose reel, allowing control of the speed of winding in or playing out the water hose. The forward/reverse valve has a forward hydraulic fluid output and a reverse hydraulic fluid output, each connected to a separate input of the hydraulic motor that drives the hose reel. When the forward/reverse valve is in the forward position, hydraulic fluid is diverted to the forward input of the hydraulic motor, causing the hydraulic motor to run in a forward direction and play out the water hose. When the forward/reverse valve is in its reverse position, hydraulic fluid flow is diverted to the hydraulic motor reverse input, causing the hydraulic motor to drive the hose reel in reverse and wind the hose back onto the hose reel.

In the electrical system, a standard female electrical plug socket may be positioned between the battery and the first pressure switch, in parallel with the water valve switch. When the water valve switch is in the open, or dumping to the reservoir, position, an electric cord may be plugged into the socket, allowing for a bypass of the water valve switch.

This bypass will allow remote operation of the hydraulic cylinder and therefore of the water valve to select either water flow to the water hose or back to the water tank. For example, an extension cord may be plugged into the socket and run into the building or house in which the operator is using the jetting hose. A standard on/off switch may be plugged into the remote end of the electrical cord. With the closing of the switch at the remote location, the operator completes the circuit to the pressure switches and can therefore select between diverting water to the water tank or diverting high pressure water to hose nozzle for cleaning operation.

A single operator using the cleaning apparatus may, due to the capability of the apparatus to recirculate pressurized water back to the water tank, preset all of the desired parameters of the cleaning apparatus at the truck or vehicle on which the cleaning apparatus is mounted. Once the parameters are preset, the single operator can initiate a cleaning operation from inside the house or building in which cleaning is to take place by simply actuating the remote on/off switch without the need to adjust water pressure, pump speed, and the like. Further, the remote connection to the electrical system may be accomplished by using wireless communication technology.

A continuous link between the wireless technology and the electrical system could keep the water valve in its jetting position until the link is broken, either intentionally or due to excessive range, loss of power, or other interruption, causing the water valve to revert to its dumping position.

While certain switches have been identified as manual or electric, all switches, such as the water valve switch, the hydraulic pump switch, and the hydraulic output selector valve switch may be operated in any suitable fashion. For example, the water valve switch may be connected to electrically control the hydraulic output selector valve to appropriately choose the hydraulic output selector valve position. There is no intention to limit the operation to one or the other.

These and other benefits of the present invention will become apparent from the following detailed description thereof taken in conjunction with the accompanying drawings, wherein like reference numerals designate like elements throughout the several views.

DESCRIPTION OF THE PREFERRED EMBODIMENTS

Figure 1:
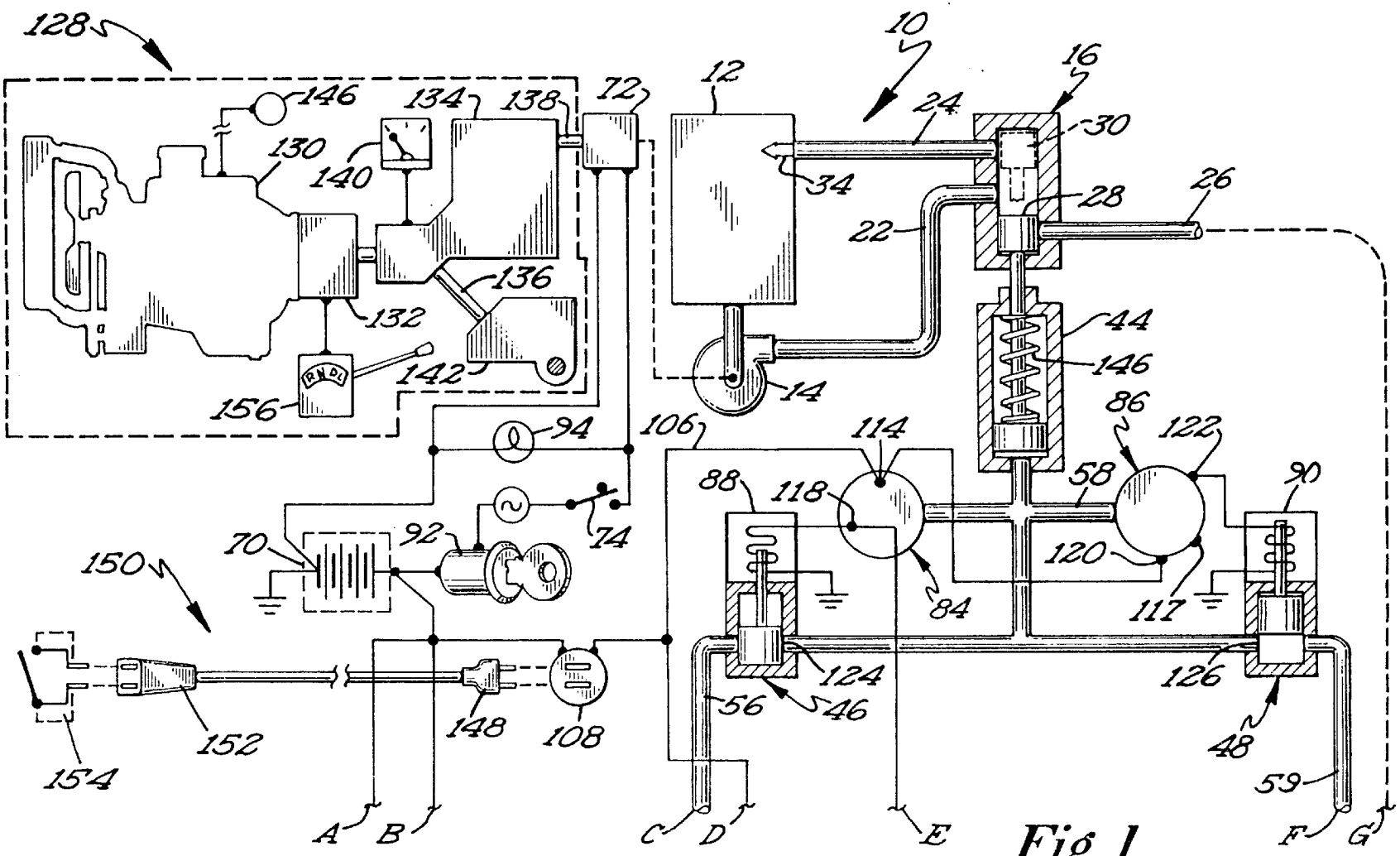
FIG. 1 shows a partial schematic layout of an embodiment of the present invention.
Figure 2:
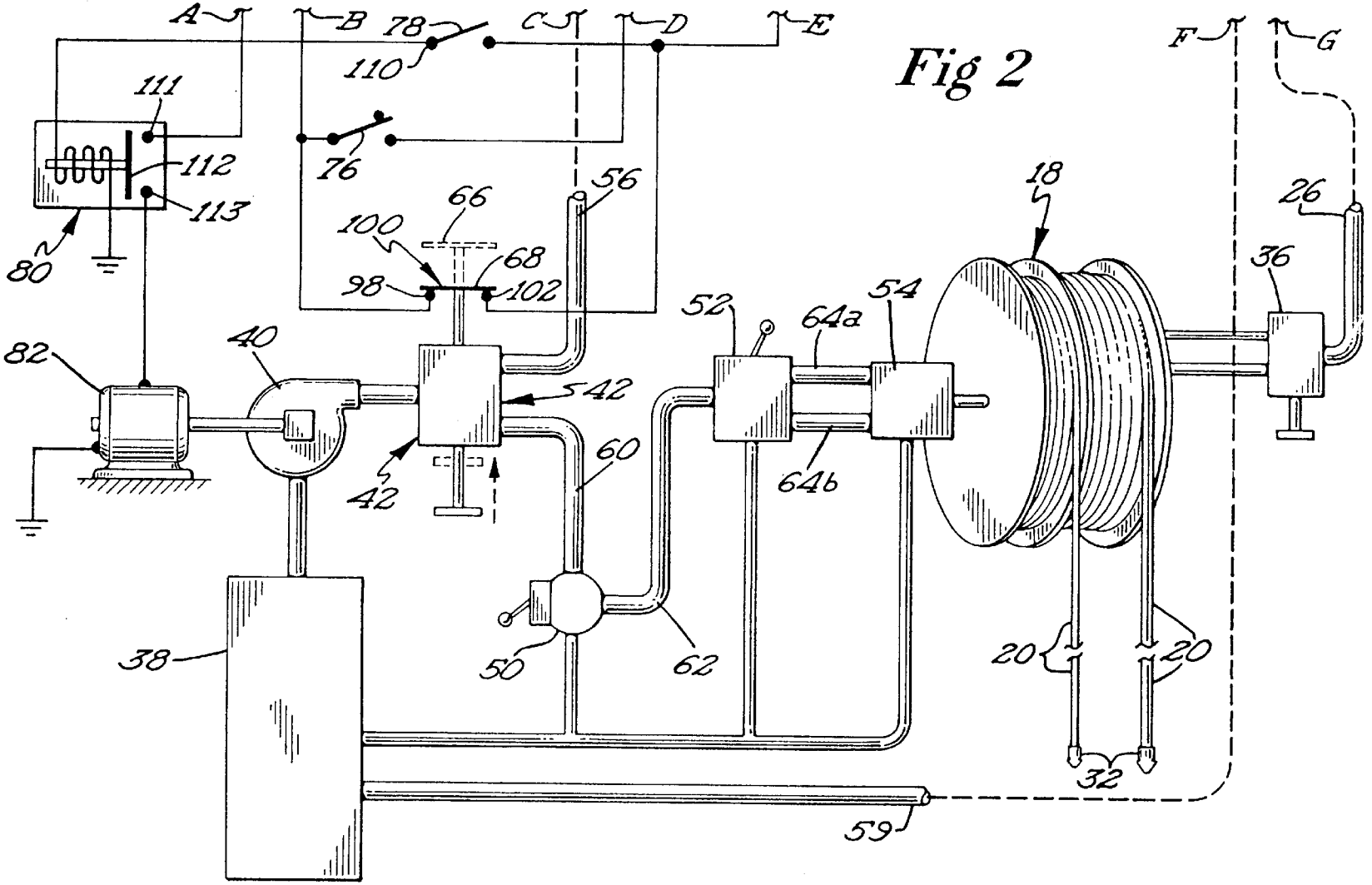
FIG. 2 shows a partial schematic layout of an embodiment of the present invention.

Referring now to the drawings, the present invention 10 may be seen in schematic form in FIGS. 1 and 2. The present invention is a high pressure cleaning apparatus designed to be mounted on a vehicle 128 such as a truck, van, or the like. While the cleaning apparatus 10 may be mounted to its own base, it has been found that a vehicle transmission 132 and battery 70, along with the bed of such a vehicle, provide an appropriate set of power sources and mounting arrangements for the high pressure cleaning apparatus 10. Further, an independent power source may also be used. It is, however, preferable to operate cleaning apparatus 10 from the power sources of the vehicle 128.

The cleaning apparatus 10 may be seen to include three systems, a cleaning liquid delivery system, a hydraulic system, and an electrical system. The three systems of the present invention 10 all work in conjunction with each other to provide high pressure water to be used for cleaning pipes, drains and the like.

Each of the systems of the cleaning apparatus 10 will be described individually. However, the relationship between the various systems requires discussion of various parts of the systems within the context of the other systems.

The cleaning liquid delivery system comprises a cleaning liquid tank 12, a jet pump 14, a valve 16, a hose reel 18, and main water delivery hoses 20. The cleaning liquid may be any suitable liquid, such as water or other solvents. Since water is a common cleaning liquid, it will be used in the discussion, it being understood that a different appropriate cleaning liquid may be substituted. Water from tank 12 is pumped through lines or conduits 22, 24, and 26 by jet pump 14, which is coupled to a drive shaft of the vehicle as will be described further below. Cleaning liquid from the tank 12 may be delivered through conduits 22 and 26 to main delivery hoses 20, or alternatively through conduits 22 and 24 back to the water tank 12. Water valve 16 diverts water flow from conduit 22 to either line 24 or line 26 depending on the desired function of cleaning apparatus 10. If it is desired to provide high pressure water for a cleaning operation, water valve 16 is adjusted so that water pressurized by jet pump 14 flows through water valve 16 and water line 26 to main delivery hoses 20. If no cleaning operation is desired, water valve 16 is adjusted to divert water flow through line 24 back to the water tank 12. Water valve 16 is therefore movable between a first position 28 in which water flow from jet pump 14 is delivered through hose 22 and is diverted by water valve 16 through line 24 back to water tank 12, and a second position 30 in which water valve 16 is positioned to divert high pressure water from jet pump 14 through lines 22 and 26 to the main delivery hoses 20. It has been found that hydraulic operation of water valve 16 is preferred. The full operation of water valve 16 will be discussed further herein below.

Water delivered from jet pump 14 through lines 22 and 26 to main delivery hoses 20 during a cleaning operation is delivered in a water spraying pattern through the operation of a nozzle 32 which is attached to the end of main delivery hoses 20. This nozzle 32 converts the high pressure water flow through main delivery hoses 20 to a high pressure water spray for use in the cleaning operation. If it is desired to cease a cleaning operation, or to divert high pressure water back to the water tank 12, water valve 16 is moved to its first position 28 in which water is diverted from line 22 to line 24 and 24 back to the water tank 12. In order to allow the maintenance of the same or nearly the same high pressure water flow as is delivered to main delivery hoses 20 and nozzle 32, a flow restrictor 34 is positioned at the end of water line 24 adjacent to or in water tank 12. This flow restrictor 34 allows high pressure water from jet pump 14 to be cycled back to the water tank 12 without a reduction in the flow pressure of the water. Because of this, the cleaning apparatus 10 does not need to be ramped up or down in water pressure in order to initiate or terminate a cleaning session. Water at pressure may be supplied to the cleaning hose 20 substantially instantaneously.

The jet pump 14 of the present invention is preferably operated at a water pressure of 4,000 pounds per square inch (PSI) with a water volume of 0–16 gallons per minute through cleaning hose 20. However, the jet pump 14 and cleaning apparatus 10 may be effectively operated at lower or higher pressures, depending upon the cleaning operation being performed. The water volume flow is adjusted accordingly depending upon the size of the pipe to be cleaned. For example, a residential sink line with a diameter of approximately 1 to 1.5 inches would use a typical water volume on the order of 3 to 4 gallons per minute at 4,000 PSI. On the other hand, larger pipes with diameters of 4, 6, 8 inches or more would preferably use increasing water volumes at 4,000 pounds per square inch for adequate cleaning.

Referring now specifically to FIG. 2, main water delivery or cleaning hoses 20 may be seen. It is desirable but not necessary to have at least two sizes of main water delivery hoses 20, to accommodate various and different cleaning operations. The cleaning apparatus 10 is capable of providing high pressure water flow to this plurality of water delivery hoses. The hoses may be of different diameters in order to provide a wider variety of high pressure water flow which will take into account the varying nature of the pipes and cleaning jobs which the cleaning apparatus 10 will be used. A water hose selector valve 36 may be placed in water line 26 in order to select the desired diameter of main water delivery hose 20. Operation of the water hose selector valve 36 routes the high pressure water to the chosen main water delivery hose 20. While the water hose selector valve 36 is shown in the figure as a manual valve, such a valve may be operated by any suitable means, including electrical or hydraulic.

The hydraulic system of the cleaning apparatus 10 comprises a hydraulic fluid reservoir 38, a hydraulic pump 40, hydraulic output selector valve 42, hydraulic cylinder 44, solenoid valves 46 and 48, flow control valve 50, forward/reverse valve 52, hydraulic motor 54, and a plurality of hydraulic fluid lines to be identified later. Hydraulic fluid reservoir 38 and hydraulic fluid pump 40 serve multiple purposes in the cleaning apparatus 10. Specifically, hydraulic pump 40 may be used either to pump hydraulic fluid under pressure through hydraulic output selector valve 42 and to hydraulic cylinder 44, or alternatively through hydraulic output selector valve 42 to flow control valve 50, forward/reverse valve 52, and forward to hydraulic motor 54. Hydraulic output selector valve 42 allows the diversion of hydraulic fluid under pressure either to hydraulic cylinder 44 through hydraulic lines 56 and 58, or alternatively to hydraulic motor 54 through hydraulic lines 60, 62, and 64*a* or 64*b*.

When it is desired to provide hydraulic pressure to hydraulic cylinder 44 to control movement of attached water valve 16, hydraulic output selector valve 42 is moved to position 66, in which hydraulic output selector valve 42 diverts hydraulic fluid from the fluid reservoir 38 through hydraulic lines 56 and 58 to provide pressure at hydraulic cylinder 44. The pressure at hydraulic cylinder 44 moves hydraulic cylinder 44 from its rest position 28 to its second extended position 30, in turn moving water valve 16 to a position in which high pressure water from jet pump 14 is diverted through water valve 16 and water line 26 to hose reel 18 and main water delivery hose 20. Hydraulic cylinder 44 is a spring return cylinder which compresses cylinder spring 146 when it moves from its rest position 28 to its extended position 30. When hydraulic pressure is released from hydraulic cylinder 44, spring 146 forces hydraulic cylinder 44 back to its rest position 28, causing water valve 16 to divert water back to water tank 12.

When it is desired to divert pressurized hydraulic fluid from hydraulic fluid reservoir 38 to the hose reel 18, hydraulic output selector valve 32 is moved to its second position 68 in which the hydraulic fluid is diverted through the hydraulic output selector valve 42 through line 60, and to flow control valve 50. Flow control valve 50 may be adjusted to regulate the amount of hydraulic fluid which flows through line 62 to forward/reverse valve 52. Forward/reverse valve 52 is adjustable to either deliver hydraulic fluid through forward line 64*a* or reverse line 64*b*. Hydraulic motor 54 has a forward input attached to line 64*a* and a reverse input attached to line 64*b*. When it is desired to operate the hose reel 18 to play out hose 20, forward/reverse valve 52 is placed in its forward position, diverting hydraulic fluid under pressure through line 64*a* to the forward input of hydraulic motor 54, causing hose reel 18 to play out main delivery hose 20. When it is desired to retract or wind in main delivery hose 20, forward/reverse valve 52 is moved to its reverse position, diverting hydraulic fluid under pressure through line 64*b* to the reverse input of hydraulic motor 54, causing hose reel 18 to wind in and retract main delivery hose 20. The operation of the hydraulic system is coordinated through operation of the electrical system. It is therefore necessary to discuss some details of the electrical system before fully discussing the operation of the hydraulic system.

The electrical system comprises a power source 70, a magnetic clutch 72, a clutch switch 74, a water valve switch 76, a hydraulic pump switch 78, a starter solenoid 80, a DC motor 82, first and second pressure switches or pop-off valves 84 and 86, and solenoids 88 and 90. Solenoid 88 directly controls the operation of normally closed solenoid valve 46, and solenoid 90 directly controls the operation of normally open solenoid valve 48. The power source 70 is preferably the battery 70 of the vehicle 128 on which the cleaning apparatus 10 is preferably mounted. The battery 70 provides 12 volt power to the electrical system of the cleaning apparatus 10. Twelve volt power is adequate to operate the components of the cleaning apparatus electrical system, yet not so powerful as to create a serious electrical shock hazard. Battery or power source 70 is electrically connected through ignition switch 92 of the vehicle 128 to terminal 111 of contact switch 112, which is actuated by starter solenoid 80.

Battery 70 is also electrically connected through ignition switch 92 to magnetic clutch switch 74, which is in turn electrically connected to a terminal of magnetic clutch 72. The other terminal of magnetic clutch 72 is electrically connected back to the other terminal of battery 70, and is also connected in parallel with a light 94. This light 94 is an indicator light indicating the status of the engagement of magnetic clutch 72. Magnetic clutch 72 is coupled to jet pump 14.

Battery 70 is also electrically connected through ignition switch 92 to a terminal of water valve switch valve 76 and also to the first terminal 98 of contact switch 100. Contact switch 100 is attached to hydraulic output selector valve 42 as is shown in FIG. 2. When hydraulic output selector valve 42 is in position to divert hydraulic fluid flow to hydraulic cylinder 44, position 66, contact switch 100 is open. When hydraulic output selector valve 42 is in position to divert hydraulic fluid to the hose reel, position 68, contact switch 100 is closed to complete an electrical circuit between its terminals 98 and 102. Terminal 102 of contact switch 100 is electrically connected to terminal 104 of hydraulic pump switch 78. Terminal 110 of hydraulic pump switch 78 is electrically connected to starter solenoid 80. Starter solenoid 80 operates normally open contact switch 112. When starter solenoid 80 is energized, contact switch 112 closes to complete a circuit between its terminals 111 and 113, and consequently an electric circuit between ignition switch 92 and DC motor 82. When starter solenoid 80 is not energized, the solenoid 80 returns to its normal position, and contact switch 112 breaks the circuit between ignition switch 92 and DC motor 82.

A female electrical plug 108 is electrically connected in parallel with water valve switch 76. Plug 108 is also electrically connected to terminal 114 of first pressure switch 84.

Pressure switch 84 is operatively connected to sense the hydraulic pressure in hydraulic line 58 at hydraulic cylinder 44. When the pressure at hydraulic cylinder 44 in hydraulic line 58 is low, and pressure switch 84 is energized, pressure switch 84 completes a circuit between input terminal 114 to output terminal 118 of pressure switch 84. This opens normally closed solenoid valve 46 by energizing solenoid 88. Energization of second pressure switch 86 will cause completion of a normally open circuit between input terminal 120 and output terminal 122 of pressure switch 86. This closes normally open solenoid valve 48 by energizing solenoid 90. At the same time, completion of the circuit between terminals 114 and 118 energized starter solenoid 80, closing contact switch 112, and initiating operation of DC motor 82 as discussed above.

When the pressure in hydraulic line 58 at hydraulic cylinder 44 is sensed by pressure switch 84 to be high, pressure switch 84, switches to break the circuit between terminals 114 and 118, de-energizing solenoid 88 of solenoid valves 46, causing solenoid valve 46 to revert to its normally closed position so as to block flow of hydraulic fluid through hydraulic line 58 at point 124. This serves to trap the high pressure in hydraulic line 58, maintaining the positioning of hydraulic cylinder 44 in its second position 30 and placing water valve 16 into a position in which water flowing from jet pump 14 through water line 22 is diverted through water valve 16 and water line 26 to water hose selector valve 36 and to main water delivery hoses 20. When it is desired to release pressure on hydraulic cylinder 44, water valve switch 76 is opened, de-energizing pressure switches 84 and 86, thereby opening solenoid valve 48, relieving hydraulic fluid pressure in line 58 back to the reservoir 38 through hydraulic line 59. Compressed spring 146 then forces cylinder 44 to retraced position 28, moving water valve 16 to redirect water through water valve 16 back to water tank 12.

Alternatively, pressure switch 84 and first solenoid valve 46 could be replaced by a one-way check valve, in hydraulic line 58, which would allow hydraulic fluid flow from hydraulic output selector valve toward cylinder 44, but not back. Appropriate changes to the electrical system to allow operation of the trapping of hydraulic pressure to be triggered from pressure switch 86 include wiring output terminal 122 of pressure switch 86 in the same manner as output terminal 118 of pressure switch 84.

The transmission and engine system of a vehicle 128 preferably provides the mechanical power for operation of the mechanical components of cleaning apparatus 10. Engine 130 of vehicle 128 drives transmission 132. A dual shaft power take off gear box 134 alternatively drives two separate shafts 136 and 138. Control over which shaft 136 or 138 is to be rotated is chosen with manual power take off control 140. Shaft 136 drives the differential 142 of vehicle 128, providing general power to the wheels to the vehicle drive train. Shaft 138 provides rotational power to which is coupled to magnetic clutch 72 gear box 134. Gear box 134 serves to translate the rotational speed of the main vehicle drive shaft to approximately the appropriate speed for the operation of jet pump 14. Magnetic clutch 72 is coupled to and in turn controls the operation of jet pump 14. A remote throttle 146 stationed at the control center for the cleaning apparatus 10 is adjustable to provide increased or decreased revolution of shaft 138, and therefore, through its coupling to magnetic clutch 72, jet pump 14. Gear shift 156 of vehicle 128 is adjusted to an appropriate gear to provide revolutionary power to drive shaft 138 when cleaning apparatus 10 is in a cleaning operation mode.

The drive shaft from the transmission 132 to the vehicle differential 142 is cut, and dual shaft power take off gear box 134 is installed. Gear box 134 has two drive shafts 136 and 138. Drive shaft 136 is coupled to the vehicle differential 142 in normal fashion to allow normal operation of the vehicle 128 by appropriate gear selection accomplished by use of gear shift selector 156. Drive shaft 138 is coupled to the main vehicle drive shaft in gear box 134 by a series of gears which serve to increase the rotational speed of shaft 148 over that of the main vehicle drive shaft. Drive shaft 138 in turn is coupled to magnetic clutch 72 which is coupled to jet pump 14. When the selection between drive shafts 136 and 138 is being made by appropriate operation of the linkage of power take off control 140, the transmission 132 is placed in neutral. When drive shaft 138 is selected, the transmission 132 is placed in low gear to prevent the transmission 132 from jumping to a higher gear when rpms of the transmission 132 increase, which could cause a pressure spike or fluctuation in the water pressure in the water delivery system. The power take off gear box 134 operates to increase the revolution speed of the jet pump 14 to provide more efficient operation of the cleaning apparatus 10. The gear box 134 will operate at a 1:1 ratio, that is one revolution of drive shaft 138 equaling one revolution of jet pump 14. However, range of ratios from approximately 1:2 to 1:3 ratio is preferable. Presently, the preferred ratio is approximately 1:2.5. The ratio may be appropriately adjusted to provide efficient operation of cleaning apparatus 10 with low engine speed. If a different type of pump or a different jet pump is used, the appropriate ratios may change accordingly.

The operation of cleaning apparatus 10 is as follows. The main functions of the cleaning apparatus 10 are the provision of high pressure cleaning liquid such as water to main water delivery hoses 20, or alternatively the shut off of water delivery to main water delivery hoses 20 and the recirculation of high pressure water from jet pump 14 through water valve 16 and back to water tank 12 without a resultant substantial change in water pressure. Further, it is desirable to be able to wind in or play out main water delivery hoses 20 either during a cleaning operation in which high pressure water is delivered through main delivery hoses 20 or in a situation in which high pressure water is diverted from jet pump 14 through water valve 16 and back to water tank 12. The operation of the cleaning apparatus 10 is such that all of these functions may be accomplished by the hydraulic, electrical, and water delivery systems of the cleaning apparatus 10. Depending upon what action is desired, various steps are taken to ensure that the proper function is performed.

First, in order to provide power to the cleaning apparatus 10, the transmission 132 of vehicle 128 must be coupled to the magnetic clutch 72 by placement of the power take off control 140 into position such that the power take off gear box 134 drives shaft 138, providing rotational power to the magnetic clutch 72 through gear box 134. It is not necessary that the clutch 72 be magnetic, but only that it be sufficient to couple power from the drive shaft 138 to the jet pump 14. In order for the magnetic clutch 72 to be operable, on-off electrical clutch switch 74 must be closed to complete an electric circuit between the battery 70 and the magnetic clutch 72. When the switch 74 is closed, it energizes the clutch 72 which allows the coupling of the rotating shaft 138 from power take off 134 to the high pressure jet pump 14 to start the jet pump 14 turning. The magnetic clutch 72 will only engage when the clutch switch 74 is closed and the ignition switch 92 of the vehicle 128 is on. This prevents unwanted engagement of clutch 72. Indicator light 94 indicates whether clutch switch 74 is closed or open. The clutch switch 74 serves as a safety feature to allow shut down of the jet pump 14 at the control center for the cleaning apparatus 10. Without clutch switch 74, shut down of the jet pump 14 could only be effected by shutting down the ignition switch 92 of the vehicle 128 or taking the transmission 132 out of gear, neither of which may be done from the control center.

Once the magnetic clutch 72 is operable and providing rotational power to jet pump 14, the conditions for the cleaning apparatus are chosen. In the situation in which water is desired to be delivered under pressure to main water delivery hoses 20 for a cleaning operation, the water valve 16 should be moved to position 30 which diverts water from jet pump 14 through water valve 16 to water line 26 and onward to main water delivery lines 20. To effect this operation, water valve switch 76 is closed, completing an electric circuit between the battery 70 and pressure switches 84 and 86. When the pressure switch 84 is energized, it begins sensing the hydraulic pressure in line 58 at hydraulic cylinder 44. Pressure switch 84 normally completes a circuit between its input terminal 114 and its output terminal 118. Pressure switch 86, when energized, completes a circuit between its input terminal 120 and output terminal 122.

When pressure switches 84 and 86 are initially energized, the completed circuits between terminals 114 and 118, and 120 and 122, respectively, energize solenoids 88 and 90. When solenoid 88 is energized, it operates solenoid valve 46 to move it from its normally closed position blocking hydraulic fluid flow to hydraulic line 58, to its open position allowing hydraulic fluid flow through hydraulic lines 56 and 58 to hydraulic cylinder 44. At the same time, energization of pressure switch 86 energizes solenoid 90 of solenoid valve 48, moving solenoid valve 48 from its normal position allowing hydraulic fluid flow through valve 48 at point 126 to a blocking position in which hydraulic fluid flow through line 58 is blocked at point 126. Consequently, solenoid valve 46 is in a position to allow hydraulic fluid flow through point 124, and solenoid valve 48 is in a position to block hydraulic fluid flow at point 126. At the same time solenoids 88 and 90 are energized, hydraulic motor 82 is energized through the operation of starter solenoid 80. Starter solenoid 80 is electrically connected through hydraulic pump switch 78 to output terminal 118 of pressure switch 84. When the normal circuit is completed between terminals 114 and 118 of pressures switch 84, starter solenoid 80 is energized, closing contact switch 112 to allow power flow from power source 70 to DC motor 82, energizing DC motor 82 and initiating operation of hydraulic fluid pump 40.

When hydraulic fluid pump 40 is energized, it begins to provide hydraulic fluid under pressure. Pressurized hydraulic fluid is pumped by hydraulic pump 40 to the hydraulic output selector valve 42. The position of hydraulic output selector valve 42 determines where the pressurized hydraulic fluid will be delivered. When hydraulic output selector valve 42 is in position 66, pressured hydraulic fluid from hydraulic fluid pump 40 will be delivered to hydraulic cylinder 44 through hydraulic lines 56 and 58. As the pressure in hydraulic line 58 begins to build, the hydraulic cylinder 44 is moved from retracted position 28 to extended position 30, which in turn serves to move attached water valve 16 from position 28 in which water is diverted back to water tank 12 to position 30 in which water from jet pump 14 is diverted through water valve 16 to water delivery lines 26 and eventually to main water delivery hoses 20.

When the pressure in hydraulic line 58 has reached a point at which it fully extends hydraulic cylinder 44, pressure switch 84 senses the high pressure in hydraulic line 58. This sensing of the high pressure in hydraulic line 58 causes the pressure switch 84 to break the electric circuit between input terminal 114 and first output terminal 118. This de-energizes solenoid 88 and moves solenoid valve 46 to its normally closed position in which it blocks flow in hydraulic line 58 at point 124. At the same time, the circuit energizing starter solenoid 80 is broken, shutting off DC motor 82. When current no longer flows to the starter solenoid 80, it is no longer energized, and contact switch 112 breaks the circuit between the battery 70 and the DC motor 82, turning DC motor 82 and hydraulic fluid pump 40 off. At this point, hydraulic fluid pump 40 is no longer needed to supply pressure to hydraulic line 58 in order to force cylinder 44 to extended position 30 in which it also moves water valve 16 to position 30, delivering water through water delivery line 26 and to main water delivery lines 20, creating instantaneous pressure.

Hydraulic pressure trapped in hydraulic line 58 forces hydraulic cylinder 44 to be maintained in extended position 30. In this extended position, spring 146 in hydraulic cylinder 44 is compressed, creating the potential to push cylinder 44 back to its original position. The hydraulic pressure in line 58 is sufficient at this point to maintain spring 146 in its compressed position. When hydraulic fluid pressure in line 58 is released, spring 146 will expand moving hydraulic cylinder 44 and water valve 16 to rest position 28.

When it is desired to stop the cleaning operation by cleaning apparatus 10, the hydraulic cylinder 44 must have the hydraulic pressure released from hydraulic line 58. In order to relieve the pressure in hydraulic line 58, the water valve switch 76 is opened, breaking the electrical circuit between the battery 70 and pressure switches 84 and 86. When pressure switch 84 is no longer energized, it reverts to its normal state, and solenoid valve 46 closes. When pressure switch 84 is de-energized, solenoid 88 and solenoid valve 46 should already be in their normal positions. Similarly, pressure switch 86 is no longer energized, breaking the electrical circuit between terminal 120 and terminal 122, de-energizing solenoid 90. When solenoids 88 and 90 de-energize, springs (not shown) within each solenoid return solenoid valves 46 and 48 to their normal positions closed and open respectively, relieving hydraulic pressure from hydraulic line 58 through return line 59. When the pressure from hydraulic line 58 has been released, spring 146 in hydraulic cylinder 44 causes hydraulic cylinder 44 to move to retracted position 28, moving water valve 16 from position 30 which diverts water to the water delivery hoses 20 to the position 28 in which water from jet pump 14 is diverted through water valve 16 to water tank 12 under pressure.

Since the hydraulic fluid pump 40 is no longer needed to maintain high pressure in hydraulic line 58, it may therefore be used to provide hydraulic fluid pressure to hydraulic motor 54 which drives hose reel 18. To effect the use of hydraulic fluid pump 40 for control of hydraulic motor 54, hydraulic output selector valve 42 is moved from its position 66 which diverts hydraulic fluid flow to hydraulic cylinder 44 to its position 68 in which it diverts hydraulic fluid flow to the flow control valve 50, forward/reverse valve 52, and hydraulic motor 54.

When hydraulic output selector valve 42 is moved to position 68, contact switch 100 completes an electrical circuit between terminals 98 and 102, supplying electrical power from battery 70 through closed hydraulic pump switch 78 to starter solenoid 80. When starter solenoid 80 is again energized, contact switch 112 closes to complete the circuit between battery 70 and DC motor 82, starting DC motor 82. DC motor 82, which is coupled to hydraulic pump 40, initiates operation of hydraulic fluid pump 40. Pressurized hydraulic fluid from hydraulic fluid reservoir 38 is pumped by hydraulic fluid pump 40 through hydraulic output selector valve 42 into hydraulic line 60 and then onward to flow control valve 50, forward/reverse valve 52, and hydraulic motor 54, in order to effect operation of the hose reel 18 to play out or wind in main water delivery hoses 20.

When hydraulic fluid is pumped by hydraulic fluid pump 40 through hydraulic output selector valve 42 and to flow control valve 50, the amount of hydraulic fluid flow through flow control valve 50 may be regulated so as to increase or decrease the rotational speed of hydraulic motor 54. Forward/reverse valve 52 allows the user to select which direction hydraulic motor 54 will rotate. When forward reverse/valve 52 is in forward mode, hydraulic fluid from hydraulic fluid pump 40 is diverted through hydraulic line 64*a* to hydraulic motor 54, winding hydraulic motor in a forward direction so as to play out main water delivery hose 20 from hose reel 18. When forward/reverse valve 52 is in the reverse position, hydraulic fluid from hydraulic fluid pump 40 is diverted to hydraulic line 64*b*, driving hydraulic motor 54 in reverse, and winding main water delivery hose 20 onto hose reel 18, with hose reel 18 moving in reverse.

Since hydraulic fluid pressure is trapped in hydraulic line 58 to maintain hydraulic cylinder 44 in extended position 30, and therefore to maintain water valve 16 in water delivery position 30, the main water delivery hoses 20 may be played out or wound in while high pressure water is spraying from nozzle 32.

When it is desired to re-divert water from jet pump 14 to main water delivery hoses 20, water valve switch 76 is closed, with hydraulic output selector valve 42 in its position 66 which diverts pressurized hydraulic fluid from hydraulic fluid reservoir 38, as pressurized by hydraulic fluid pump 40, through hydraulic output selector valve 42, hydraulic line 56, and hydraulic line 58, building up the pressure on hydraulic cylinder 44.

As has been mentioned, operation of the cleaning apparatus 10 by a single operator within the building or home in which a cleaning is taking place is desirable. To accommodate control of the delivery of water under pressure either to main water delivery hose 20 or back to the water tank 12, female electrical outlet 108 may be electrically connected between battery 70 and input terminal 114 of pressure switch 84. Female electrical plug 108 is connected in parallel with water valve switch 76, allowing a user to plug in male end 148 of electrical cord 150 to female electrical plug 108, extending electrical cord 150 into the house or building in which cleaning is taking place. The female end 152 of electrical cord of 150 serves as a receptacle for a removable switch 154 which is a simply on/off switch. Will the water valve switch 76 in the open position, the user can use removable on/off switch 154 as a remote water valve switch. When the removable remote switch 154 is closed, a electrical circuit is completed between battery 70 and terminal 114 of pressure switch 84, even though water valve switch 76 is open.

The use of female electrical plug 108, electrical cord 150, and switch 154 allows the user to bypass water valve switch 76. When the circuit between battery 70 and pressure switch 84 is completed, the pressure switches 84 and 86 are energized. Pressure switch 84 effects completion of the circuit between terminal 118 of pressure switch 84 and starter solenoid 80, closing contact switch 112 and initiating operation of the DC motor 82 and hydraulic fluid pump 40.

Water hose selector valve 36 is positioned in water line 26 between hose reel 18 and water valve 16. At times, it may be desirable to be able to select a different diameter main water delivery hose 20 for the varied functions of the cleaning apparatus 10. As may be seen in FIG. 2, both small and large diameter main water delivery hoses 20 are wound on hose reel 18. Water hose selector valve 36 is movable between a position in which small diameter hose 20 is selected, or a second position in which larger diameter hose 20 is selected.

Water hose selector valve 36 and hydraulic output selector valve 42 are shown as manually operable valves. While manually operable valves will serve the appropriate purpose, electrically or hydraulically operated valves would also suffice. Since the electrical system of cleaning apparatus 10 operates preferably from the twelve volt battery 70 of the vehicle 128 on which the cleaning apparatus 10 is mounted, the electrical cord 150 is also operating on a twelve volt circuit. The female end 152 of electrical cord 150 extends into the home or building in which the cleaning will be taking place. This is a safety feature of the cleaning apparatus 10. If the male end 148 of electrical cord 150 were to extend into the home or building in which a cleaning is taking place, a homeowner or other person wishing to be helpful might plug the male end 148 of the electrical cord 150 into a standard 120 volt electrical outlet. If this were to happen, the electrical circuit of the cleaning apparatus 10 would be overloaded, causing severe damage to the electrical system. Because the female end 132 of electrical cord 150 extends into the home or building in which the cleaning is taking place, there is no temptation for a homeowner or other person to plug the cord 150 into a standard electrical outlet.

Since the electrical system of the cleaning apparatus 10 operates on 12 volts, the risk of serious electrical shock is greatly reduced. If the electrical cord 150 of the cleaning apparatus 10 is inadvertently unplugged from female electrical outlet 108, the cleaning apparatus 10 will revert to a position in which water from jet pump 14 is diverted through water valve 16 back to water tank 12. The reason for this is that when the remote on/off switch 154 is being used, the water valve switch 76 is placed in its open position, but is bypassed by the electrical cord 150 and removable remote switch 154. If the electrical cord 150 becomes unplugged from female electrical outlet 108, the electrical circuit between battery 70 and terminal 114 of the pressure switch 84 will be broken, and since the pressure switches 84 and 86 are no longer energized, they will revert to their normally closed positions, releasing electrical energization from solenoids 88 and 90, causing solenoid valve 48 to open the blockage of hydraulic line 58 at point 126, releasing pressure from hydraulic cylinder 44, by relief to hydraulic reservoir 38 through line 59, causing water valve 16 and hydraulic cylinder 44 to move to position 28 which diverts water from jet pump 14 through water valve 16 and back to water tank 12.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

I claim:

1. A vehicle mounted high pressure cleaning apparatus utilizing a cleaning liquid comprising:

a power source;

a cleaning liquid reservoir;

a pump, operatively connected to said power source, for generating high pressure liquid flow and having an inlet and an outlet, said inlet operatively connected in fluid flow relationship with said liquid reservoir;

a first conduit having a first end operatively connected to said outlet;

a first valve connected to the second end of said first conduit and a second end;

a second conduit operatively connected between said first valve and said liquid reservoir;

a cleaning hose operatively connected in fluid flow relationship with said first valve;

said first valve being movable between a first jetting position in which high pressure cleaning liquid is directed to said cleaning hose, and a second dumping position in which said high pressure cleaning liquid is directed back to said liquid reservoir through said second conduit without substantially changing the said high pressure;

a hydraulic reservoir holding hydraulic fluid;

a hydraulic pump having an inlet and an outlet, said inlet operatively connected in fluid flow relationship with said hydraulic reservoir;

a hydraulic line connected at one end to said hydraulic pump outlet;

a hydraulic cylinder operatively connected in fluid flow relationship with the other end of said hydraulic line, said hydraulic cylinder movable between a first retracted position when said hydraulic cylinder is a predetermined low under pressure and a second extended position when said hydraulic cylinder is under a predetermined high pressure, said cylinder mechanically linked to said first valve, whereby said first valve is moved to said first jetting position when said hydraulic cylinder is in said second extended position and said first valve is moved to said second dumping position when said hydraulic cylinder is in said first retracted position;

a first electrical pressure switch having an input terminal, and an output terminal, said first pressure switch operatively connected to sense the hydraulic pressure in said hydraulic line at said hydraulic cylinder, and said input terminal electrically connected to said output terminal when said first pressure switch senses said predetermined low pressure, and said input terminal electrically disconnected from said output terminal when said first pressure switch senses said predetermined high pressure;

a first solenoid valve having a first solenoid electrically connected to said output terminal of said first pressure switch, and a first normally closed solenoid valve mechanically linked to said first solenoid, said first solenoid valve operatively connected in fluid flow relationship with said hydraulic line between said hydraulic pump and said hydraulic cylinder, said first solenoid valve movable between a normally closed position obstructing fluid flow in said hydraulic line, and an open position not obstructing hydraulic fluid flow in said hydraulic line when said low pressure is sensed;

whereby when said first pressure switch senses said predetermined high hydraulic pressure at said hydraulic cylinder, said pressure switch breaks the electrical circuit between said input terminal and said output terminal, and said first solenoid is de-energized to move said first solenoid valve to said blocking position, trapping high pressure at said hydraulic cylinder valve, thereby diverting cleaning liquid through said first valve to said cleaning hose.

2. A vehicle mounted high pressure cleaning apparatus as described in claim 1, and further comprising:

a hose reel operatively storing said cleaning hose and including a hydraulic motor for winding in and winding out of said cleaning hose;

a second hydraulic fluid line operatively connected at one end in fluid flow relationship with said hydraulic motor of said hose reel;

a hydraulic output selector valve having a hydraulic input, and first and second hydraulic outputs, said hydraulic output selector valve positioned such that said hydraulic input is in fluid flow relationship with a first section of said first hydraulic line between said hydraulic reservoir and said first solenoid valve, said first output of said hydraulic output selector valve is in fluid flow relationship with a second section of said first hydraulic line at a position between said hydraulic input and said first solenoid valve, and said second hydraulic output in fluid flow relationship with the other end of said second hydraulic line, said hydraulic output selector valve moveable between a first selector valve position in which said hydraulic output selector valve diverts hydraulic fluid flow from said first section of said first hydraulic line to said second section of said first hydraulic line and said hydraulic cylinder, and a second selector valve position in which said selector valve diverts hydraulic fluid flow from said first section of said first hydraulic line to said second hydraulic line and said hydraulic motor of said hose reel; and a third hydraulic fluid line operatively connected at one end in fluid flow relationship with said second section of said first hydraulic line at a position between said first solenoid valve and said hydraulic cylinder and at its other end in fluid flow relationship with said hydraulic reservoir;

a second electrical pressure switch having an input terminal, and an output terminal, said second pressure switch input terminal electrically connected to said second pressure switch output terminal when said second pressure switch is energized, and said second pressure switch input terminal electrically disconnected from said second pressure switch output terminal when said second pressure switch is de-energized;

a second solenoid valve having a second solenoid electrically connected to said output terminal of said second pressure switch, and a second normally open solenoid valve mechanically linked to said second solenoid, said second solenoid valve operatively connected in fluid flow relationship with said third hydraulic line between said hydraulic cylinder and said hydraulic fluid reservoir, said second solenoid valve movable between a first position in which said third hydraulic line is not blocked, and a second position in which fluid flow through said third hydraulic line is blocked;

whereby when said second pressure switch is energized, said second pressure switch energizes said second solenoid and said second solenoid moves said second solenoid valve to its second position to block flow of hydraulic fluid through said third hydraulic line, trapping pressure at said hydraulic cylinder.

3. A vehicle mounted high pressure cleaning apparatus as described in claim 2, and further comprising:

a flow control valve operatively connected in fluid flow relationship with said second hydraulic line between said hydraulic output selector valve and said hydraulic motor of said hose reel;

a forward/reverse valve operatively connected in fluid flow connection with said second hydraulic line between said flow control valve and said hydraulic motor of said hose reel, said forward/reverse valve having a forward output hydraulic line and a reverse output hydraulic line;

said hydraulic motor of said hose reel having a forward input, a reverse input, and an output, said forward input of said hydraulic motor operatively connected in fluid flow relationship said forward hydraulic line of said forward/reverse valve, and said reverse input of said hydraulic motor operatively connected in fluid flow relationship with said reverse hydraulic line of said forward/reverse valve;

said forward/reverse valve being movable between a first position which said forward/reverse valve directs hydraulic fluid flow from said second hydraulic line to said forward output hydraulic line, and a second position in which said forward/reverse valve directs hydraulic fluid flow in said second hydraulic line to said reverse output hydraulic line;

whereby when said forward/reverse valve is in said forward position, said hydraulic motor of said hose reel operates in a forward operating mode which winds out said cleaning hose by winding out said hose reel, and when said forward/reverse valve is in said reverse position, said hydraulic motor of said hose reel is driven in a reverse direction which winds in said cleaning hose by winding in said hose reel.

4. The vehicle mounted high pressure cleaning apparatus of claim 2 and further comprising:

a liquid valve switch connected between the input terminal of said first pressure switch and said power source, said liquid valve switch movable between a closed position in which said first pressure switch and said power source are electrically connected, and a second open position in which said power source and said first pressure switch are electrically separated;

whereby when said liquid valve switch is in said open position, said first and said second pressure switches are de-energized, said second solenoid valve reverts to its normally opened position, releasing pressure on said hydraulic cylinder, which in turn operates said first valve to direct cleaning liquid flow back to said cleaning liquid reservoir through said second conduit.

5. The vehicle mounted high pressure cleaning apparatus of claim 4, and further comprising:

a remote operation switch moveable between an open position and a closed position, said remote operation switch connected in parallel with said water valve switch, whereby said water valve switch may be by-passed from a remote location when said water valve switch is in said open position.

6. The vehicle mounted high pressure cleaning apparatus of claim 4, and further comprising:

a female electrical socket connected in parallel with said water valve switch;

an electrical cord having a male end and a female end, said male end plugged into said female electrical socket; and a remote operation switch connected to said female end of said electrical cord, said remote operation switch moveable between an open position and a closed position, whereby said water valve switch may be by-passed from a remote location when said water valve switch is in said open position.

7. A vehicle mounted high pressure cleaning apparatus comprising:

a cleaning liquid delivery system comprising:

a water reservoir holding water;

a water valve;

first and second water hoses, said first water hose connected at one end to said water reservoir, and between its ends to said water valve, said second water hose operatively connected between said water valve and said water reservoir, said water valve operable to direct high pressure water either through said first water hose to its other end, or back to said reservoir through said second water hose;

a water pump operatively connected to generate high pressure water flow from said water reservoir to said first water hose;

a hydraulic system comprising:

a hydraulic reservoir holding hydraulic fluid;

a first hydraulic line connected at one end to said hydraulic reservoir;

a hydraulic pump having a DC motor, said hydraulic pump operatively connected to generate hydraulic fluid flow through said first hydraulic line;

a hydraulic cylinder connected to the other end of said hydraulic line, said hydraulic cylinder movable between a first rest position in which no hydraulic fluid pressure is present at said hydraulic cylinder, and a second operating position in which said hydraulic cylinder is actuated by hydraulic pressure at said hydraulic cylinder, and said hydraulic cylinder operatively connected to said water valve to cause said water valve to direct high pressure water to said other end of said first water hose when said hydraulic cylinder is in said operating position, and to cause said water valve to direct high pressure water back to said water reservoir through said second water hose when said hydraulic cylinder is in said rest position; and an electrical system comprising:

a power source;

a first normally closed pressure switch having an input terminal, a normally closed terminal, and a normally open terminal, said first pressure switch input terminal connected to said power source, said first pressure switch fluidically connected to said first hydraulic line to sense the hydraulic pressure at said hydraulic cylinder, said first normally closed pressure switch being normally closed when the hydraulic pressure at said hydraulic cylinder is low, and said normally closed pressure switch opening when the hydraulic pressure at said hydraulic cylinder is at a predetermined high level;

a first solenoid operatively electrically connected to the normally open terminal of said first pressure switch;

a first normally solenoid valve operatively electrically connected to said first solenoid, and fluidically connected to said first hydraulic line between said hydraulic reservoir and said hydraulic cylinder, said normally open solenoid valve movable between a first open position in which said first hydraulic line is free and unobstructed, and a second closed position in which said first hydraulic line is closed, said first solenoid being energized when said first pressure switch senses said predetermined high pressure at said hydraulic cylinder, and said first solenoid valve moving to its second position when said first solenoid is energized, wherein said hydraulic cylinder is locked in said second operating position, whereby water is directed through said first water hose to its said other end; and a starter solenoid operatively electrically connected between the normally closed terminal of said first pressure switch and said DC motor of said hydraulic pump, whereby when the hydraulic pressure at said hydraulic cylinder is low, said starter solenoid completes a circuit between said power source and said DC motor, operating said hydraulic pump, and when the pressure at said hydraulic cylinder is low, said starter solenoid breaks the circuit between said power source and said DC motor, shutting off said hydraulic pump.

8. The vehicle mounted high pressure cleaning apparatus described in claim 7 and further comprising:

a second hydraulic line;

a hydraulic output selector valve in fluid flow connection with said first hydraulic line between said hydraulic reservoir and said first normally opened solenoid valve, and said selector valve also connected to one end of said second hydraulic line, said hydraulic selector valve moveable between a first water valve position in which said hydraulic fluid is directed to said hydraulic cylinder and a second reel motor position in which said hydraulic fluid is directed to said second hydraulic line;

a flow control valve connected to the other end of said second hydraulic line:

a third hydraulic line;

a forward/reverse valve connected by said third hydraulic line to said flow control valve, said forward/reverse valve having a forward hydraulic fluid output line and a reverse hydraulic fluid output line, said forward/reverse valve movable between a forward position in which hydraulic fluid flow from said third hydraulic line is directed to said forward hydraulic output line, and a reverse position in which said hydraulic fluid flow from said third hydraulic line is directed to said reverse hydraulic output line;

a hose reel onto which said first water hose is partially wound;

a hydraulic reel motor having a forward input, a reverse input, and an output, said forward input connected to said forward hydraulic output line of said forward/reverse valve and said reverse input connected to said reverse hydraulic output line of said forward/reverse valve, whereby when said forward/reverse valve is in said forward position, said hydraulic motor operates in a forward direction, and when said forward/reverse valve is in said reverse position, said hydraulic reel motor operates in a reverse direction, and said hydraulic output reel motor being operatively connected to said hose reel to wind out said first water hose when said hydraulic reel motor is operating in said forward direction, and to wind in said first water hose said hydraulic reel motor is operating in said reverse direction.

9. The vehicle mounted high pressure cleaning apparatus of claim 7, and further comprising:

a first nozzle connected to the other end of said first hose to generate a high pressure water spray;

a flow restrictor connected between said second hose and said water reservoir, whereby when said high pressure water is diverted by said valve back to said water reservoir, said high pressure water remains at the same pressure.

10. A vehicle mounted high pressure cleaning apparatus utilizing a cleaning liquid comprising:

said vehicle including an engine, a transmission, a differential, and a drive shaft;

a power source;

a cleaning liquid reservoir;

a pump, operatively connected to said power source, for generating high pressure liquid flow and having an inlet and an outlet, said inlet operatively connected in fluid flow relationship with said liquid reservoir;

a first conduit having a first end operatively connected to said outlet;

a first valve connected to the second end of said first conduit and a second end;

a second conduit operatively connected between said first valve and said liquid reservoir;

a cleaning hose operatively connected in fluid flow relationship with said first valve;

said first valve being movable between a first jetting position in which high pressure cleaning liquid is directed to said cleaning hose, and a second dumping position in which said high pressure cleaning liquid is directed back to said liquid reservoir through said second conduit without substantially changing the said high pressure;

a hydraulic reservoir holding hydraulic fluid:

a hydraulic pump having an inlet and an outlet, said inlet operatively connected in fluid flow relationship with said hydraulic reservoir;

a hydraulic line connected at one end to said hydraulic pump outlet;

a hydraulic cylinder operatively connected in fluid flow relationship with the other end of said hydraulic line, said hydraulic cylinder movable between a first retracted position when said hydraulic cylinder is a predetermined low under pressure and a second extended position when said hydraulic cylinder is under a predetermined high pressure, said cylinder mechanically linked to said first valve, whereby said first valve is moved to said first jetting position when said hydraulic cylinder is in said second extended position and said first valve is moved to said second dumping position when said hydraulic cylinder is in said first retracted position, a dual shaft power take off gear box having a first drive shaft and a second drive shaft, said dual shaft power take off gear box coupled to the vehicle drive shaft, said first drive shaft coupled to said vehicle differential;

a power take off control operatively connected to said dual shaft power take off to choose between coupling of the vehicle transmission to said gearbox or to the vehicle differential;

a clutch, coupled both to said second drive shaft of said gearbox and to said pump between said gear box and said pump; and a clutch switch operatively electrically connected between said power source and said clutch, whereby when said clutch switch is closed, said clutch is energized and said clutch couples drive power from said second drive shaft of said dual shaft power take off gear box to said pump.

11. The vehicle mounted high pressure cleaning apparatus of claim 10, wherein said gear box increases the rotational speed of said second gear box drive shaft by a predetermined ratio of the vehicle drive shaft.

12. The vehicle mounted high pressure cleaning apparatus of claim 11, wherein said ratio is approximately 1:2 to 1:3.

13. The vehicle mounted high pressure cleaning apparatus of claim 12, wherein said ratio is approximately 1:2.5.

* * * * *